US008476608B2

(12) United States Patent
Morton et al.

(10) Patent No.: US 8,476,608 B2
(45) Date of Patent: Jul. 2, 2013

(54) COMPACT HIGH PRECISION ADJUSTABLE BEAM DEFINING APERTURE

(75) Inventors: Simon A. Morton, Berkeley, CA (US); Jeffrey Dickert, El Sobrante, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 13/533,876

(22) Filed: Jun. 26, 2012

(65) Prior Publication Data

US 2013/0020495 A1 Jan. 24, 2013

Related U.S. Application Data

(60) Provisional application No. 61/505,632, filed on Jul. 8, 2011.

(51) Int. Cl.
*G21K 1/04* (2006.01)

(52) U.S. Cl.
CPC ..... *G21K 1/04* (2013.01)
USPC ..... 250/492.3; 378/150

(58) Field of Classification Search
USPC ..... 250/492.3; 378/150
See application file for complete search history.

(56) References Cited

U.S. PATENT DOCUMENTS

2011/0049361 A1* 3/2011 Preikszas et al. ..... 250/306

* cited by examiner

*Primary Examiner* — Kiet T Nguyen
(74) *Attorney, Agent, or Firm* — Lawrence Berkeley National Laboratory

(57) ABSTRACT

The present invention provides an adjustable aperture for limiting the dimension of a beam of energy. In an exemplary embodiment, the aperture includes (1) at least one piezoelectric bender, where a fixed end of the bender is attached to a common support structure via a first attachment and where a movable end of the bender is movable in response to an actuating voltage applied to the bender and (2) at least one blade attached to the movable end of the bender via a second attachment such that the blade is capable of impinging upon the beam. In an exemplary embodiment, the beam of energy is electromagnetic radiation. In an exemplary embodiment, the beam of energy is X-rays.

24 Claims, 9 Drawing Sheets

COMPACT HIGH PRECISION ADJUSTABLE BEAM DEFINING APERTURE

RELATED APPLICATIONS

This application is based upon and claims priority to U.S. Provisional Patent Application Ser. No. 61/505,632, filed Jul. 8, 2011, entitled Compact High Precision Adjustable Beam Defining Aperture, Morton A. Simon and Jeff Dickert, inventors, the contents of that application incorporated by reference as if fully set forth herein in its entirety.

STATEMENT OF GOVERNMENT SUPPORT

This invention was made with government support under Contract No. DE-AC02-05CH11231 awarded by the U.S. Department of Energy, under Grant No. 68172-0010-08-LK from Los Alamos National Security LLC, and under National Institutes of Health Interagency Grant No. Y1-GM-9064-12. The government has certain rights in this invention.

FIELD OF THE INVENTION

The present invention relates to the field of apertures, and particularly relates to a compact high precision adjustable beam defining aperture.

BACKGROUND OF THE INVENTION

1. Need

In X-ray science it is frequently necessary to reduce the dimensions of a beam of X-rays to a particular optimal size dictated by the experiment.

2. Prior Art

This is often achieved by inserting an adjustable aperture into the beam that consists of moveable "slit blades" made of a dense material which absorbs, or deflect, the unwanted X-rays allowing only the remaining tightly defined beam of the required dimensions to pass through. In many cases (e.g., protein crystallography) where the goal is to achieve a tightly focused X-ray spot with dimensions (which in the ideal case) are closely matched to that of the sample being studied, this slit assembly must be positioned as close as possible to the sample if optimal performance is to be achieved. However, in the immediate vicinity of the sample the available space is extremely limited because many other experimental systems are also clustered tightly around the core experimental area. Hence there is significant demand for a beam defining slit system that is as compact as possible in all three dimensions.

Three prior art approaches are typically used to tackle this problem.

Interchangeable Fixed Apertures

A prior art interchangeable fixed apertures does not allow for the aperture size itself is to be adjustable but instead provides a range of different fixed sized "pinholes" that may be interchanged by a motor drive or installed manually by the experimenter. This is the most compact solution but only a limited number of discrete sizes are available and each one may require re-alignment by skilled staff after installation.

XY Slits

Prior art XY slits typically consist of 4 electric motor driven blades arranged in a "+" shape with above and below blades 110 which are above and below abeam 140 and left and right blades 120 that are to the left and right of beam 140, and that are all approximately perpendicular to beam 140, as shown in prior art FIG. 1. Because all the mechanical and motor systems 130 are perpendicular to the axis of beam 140, the whole assembly may typically be several inches wide and take up a considerable amount of valuable space. The blade pairs 110 and 120 are also typically arranged one-behind-the-other so that the rear pair 120 may be a greater distance from the sample than is optimal. The system may also be mechanically complex with motors, encoders, and gears 130.

XX slits Mounted at the Tips of Extended Lever Arms

Prior art XY slits mounted at the tips of extended lever arms has slit blades mounted on the end of long thin lever arms forming an extended "snout" and are then driven through a mechanical linkage by electric motors set back from the aperture. This allows the parts of the assembly that immediately abut the sample area to be kept more compact, but at the expense of introducing a mechanical linkage system that increases the size of the assembly as a whole, adds additional complexity, and reduces the ultimate accuracy.

Therefore, a compact high precision adjustable beam defining aperture is needed.

SUMMARY OF THE INVENTION

The present invention provides an adjustable aperture for a beam of energy. In an exemplary embodiment, the aperture includes (1) at least one piezoelectric bender, where a fixed end of the bender is attached to a common support structure via a first attachment and where a movable end of the bender is movable in response to an actuating voltage applied to the bender, and (2) at least one blade attached to the movable end of the bender via a second attachment such that the blade is capable of impinging upon the beam. In an exemplary embodiment, the beam of energy is electromagnetic radiation, In an exemplary embodiment, the beam of energy is X-rays.

DETAILED DESCRIPTION OF THE INVENTION

The present invention provides an adjustable aperture for a beam of energy. In an exemplary embodiment, the aperture includes at least one piezoelectric bender, where a fixed end of the bender is attached to a common support structure via a first attachment and where a movable end of the bender is movable in response to an actuating voltage applied to the bender, thereby being able to impinge upon the beam. In an exemplary embodiment, the beam of energy is electromagnetic radiation. In an exemplary embodiment, the beam of energy is X-rays.

The present invention also provides an adjustable aperture for a beam of particles. In an exemplary embodiment, the aperture includes (1) at least one piezoelectric bender, where a fixed end of the bender is attached to a common support structure via a first attachment and where a movable end of the bender is movable in response to an actuating voltage applied to the bender and (2) at least one blade attached. to the movable end of the bender via a second attachment such that the blade is capable of impinging upon the beam of particles.

In an exemplary embodiment, the aperture includes at least one piezoelectric bender, where a fixed end of the bender is attached to a common support structure via a first attachment and where a movable end of the bender is movable in response to an actuating voltage applied to the bender, thereby being able to impinge upon the beam.

Figure 1:
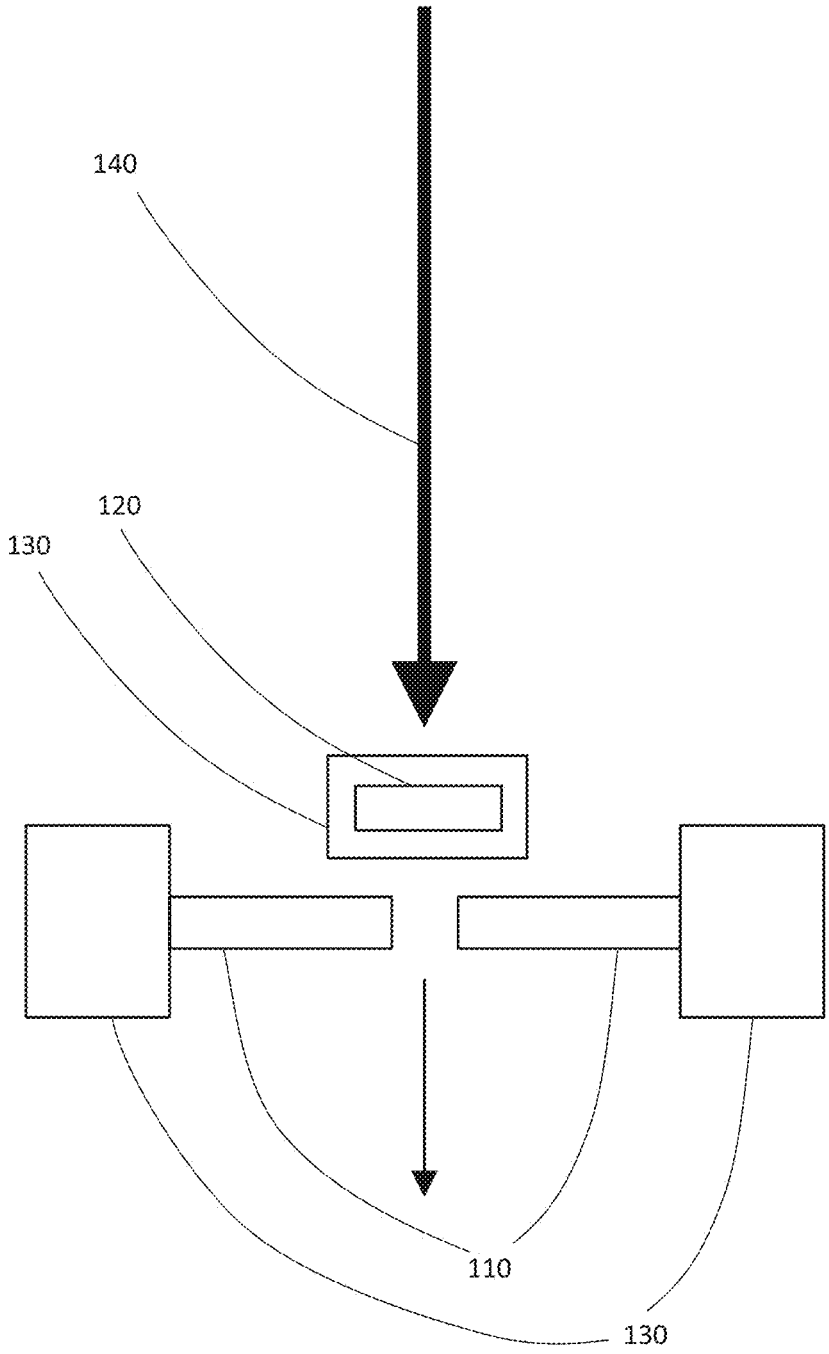
FIG. 1 (Prior Art)
FIG. 1 is a schematic of a prior art device employing mechanically driven XY slits disposed perpendicularly to the axis of an incoming beam.
Figure 2A:
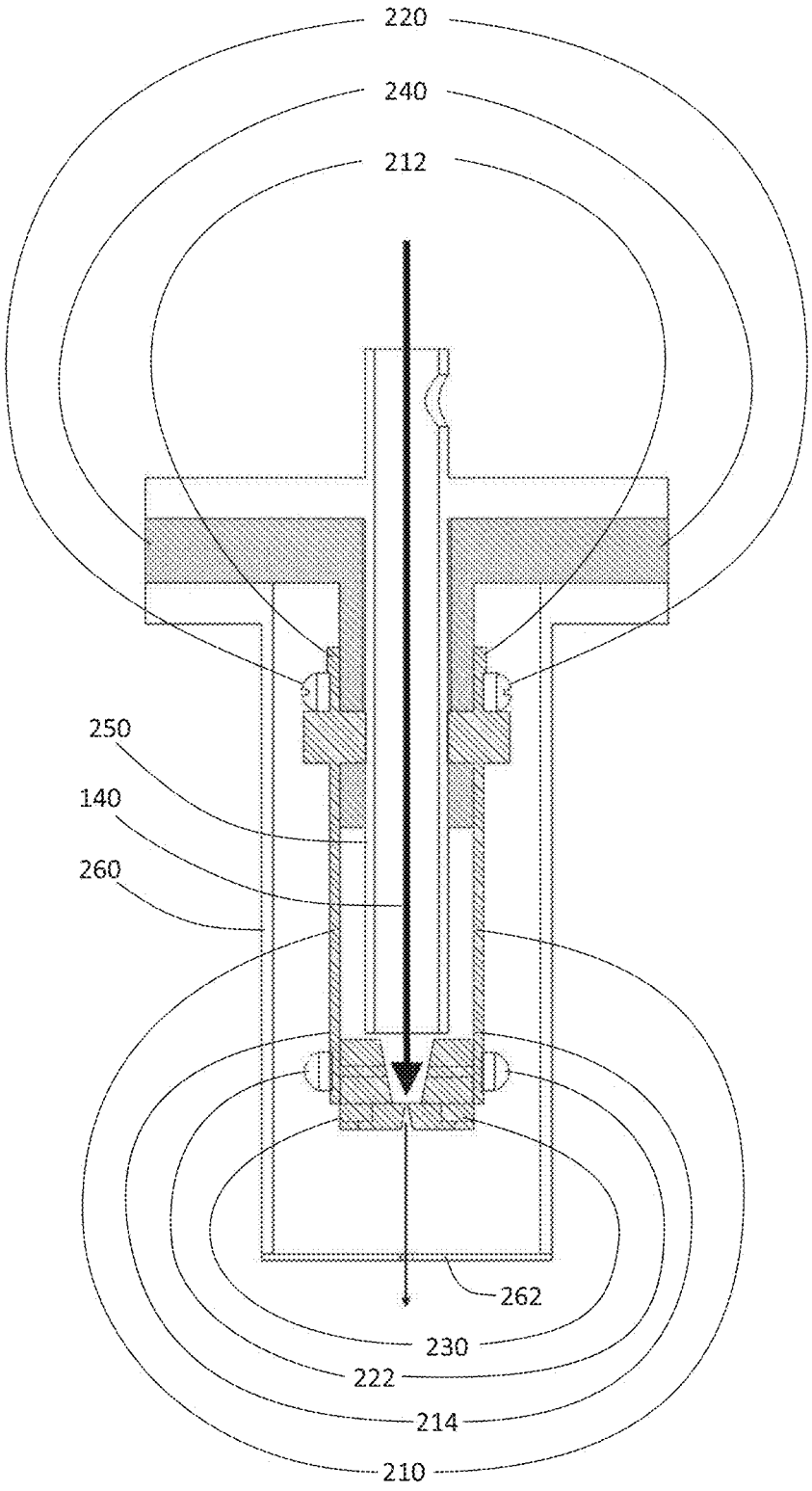
FIG. 2A is a schematic cross section of an exemplary embodiment of the present invention including at least one piezoelectric bender.
Figure 2B:
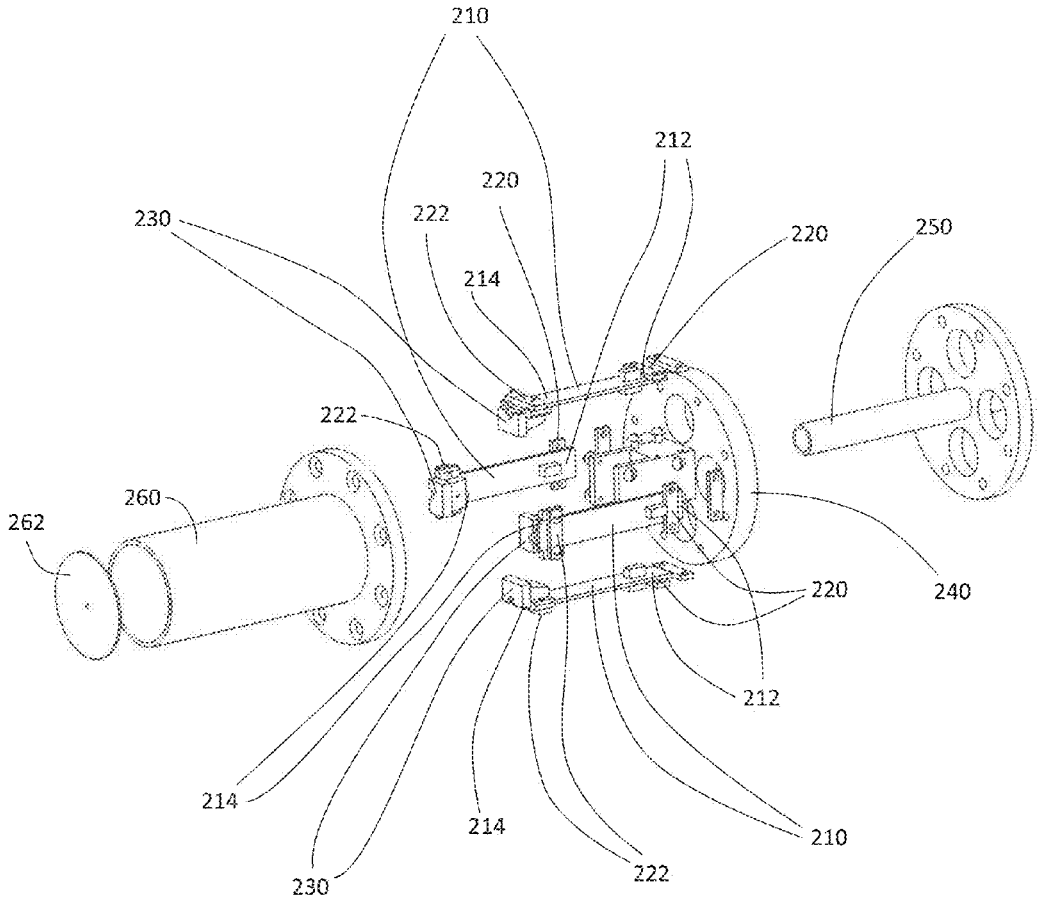
FIG. 2B is an exploded three dimensional schematic of the embodiment illustrated in FIG. 2A.

Referring to FIG. 2A and FIG. 2B, in an exemplary embodiment, the present invention includes at least one piezoelectric bender 210, where a fixed end 212 of the bender is attached to a common support structure 240 via a first attachment 220 and where a movable end 214 of bender 210 is movable in response to an actuating voltage applied to bender 210 and at least one blade 230 attached to movable end 214 via a second attachment 222 such that blade 230 is capable of impinging upon the beam 140. In an exemplary embodiment, beam 140 is electromagnetic radiation. In an exemplary embodiment, beam 140 is X-rays.

Bender

In an exemplary embodiment, bender 210 is positioned approximately parallel to beam 140. In an exemplary embodiment, bender 210 includes at least one strain gauge. In an exemplary embodiment, the strain gauge is configured to measure dimensional changes of bender 210. In an exemplary embodiment, the strain gauge is configured to provide data about the position of blade 230, In an exemplary embodiment, the strain gauge is an integrated solid-state strain gauge.

First Attachment

In an exemplary embodiment, firs attachment 220 includes plastic.

Support Structure

In an exemplary embodiment, support structure 240 includes holes through which bender 210 can pass.

Conductors

In an exemplary embodiment, bender 210 includes (i) at least one actuator conductor, (ii) at least one signal conductor, and (iii) at least one reference conductor. In an exemplary embodiment, the actuator conductor and the reference conductor are configured to carry the actuating voltage. In an exemplary embodiment, the signal conductor and the reference conductor are configured to carry a signal from at least one strain gauge attached to bender 210. In an exemplary embodiment, at least one of the conductors is attached to support structure 240 via a third attachment.

Material

In an exemplary embodiment, bender 210 includes a non-conducting material. In an exemplary embodiment, the material can be electrically isolated.

Diagnostics

In an exemplary embodiment, bender 210 includes at least one diagnostics sensor.

Blade

In an exemplary embodiment, blade 230 is approximately perpendicular to beam 140. In an exemplary embodiment, blade 230 is configured as an electrical conductor. In an exemplary embodiment, blade 230 is configured as an electrical emitter.

Diagnostics

Figure 2C:
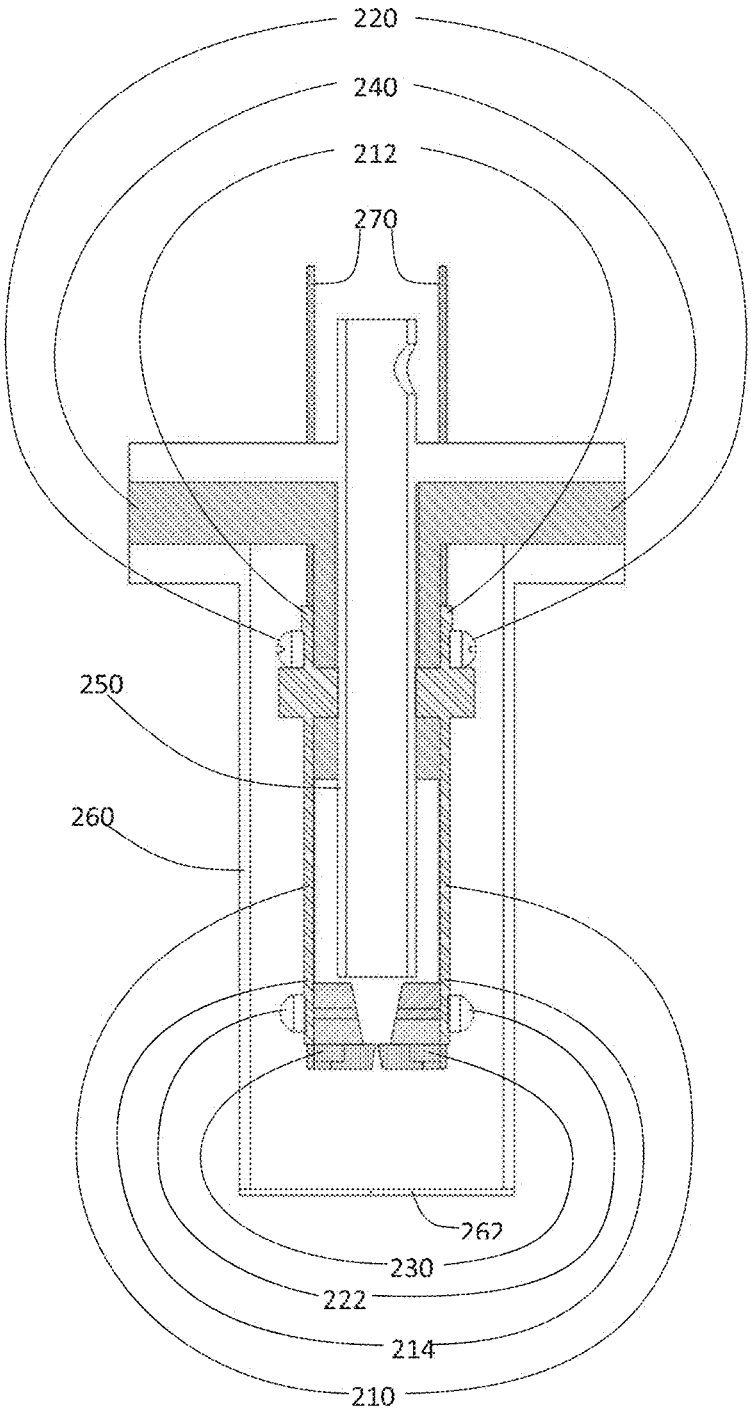
FIG. 2C is a schematic illustration of an exemplary embodiment of the invention similar to that illustrated in FIG. 2A, including a further embodiment.

In an exemplary embodiment, blade 230 is electrically isolated. Referring to FIG. 2C, in a further embodiment, blade 230 includes wires 270 that are configured to provide diagnostic information about beam 140 impinging on blade 230 that can be used to measure the intensity or position of beam 140.

Material

Figure 3A:
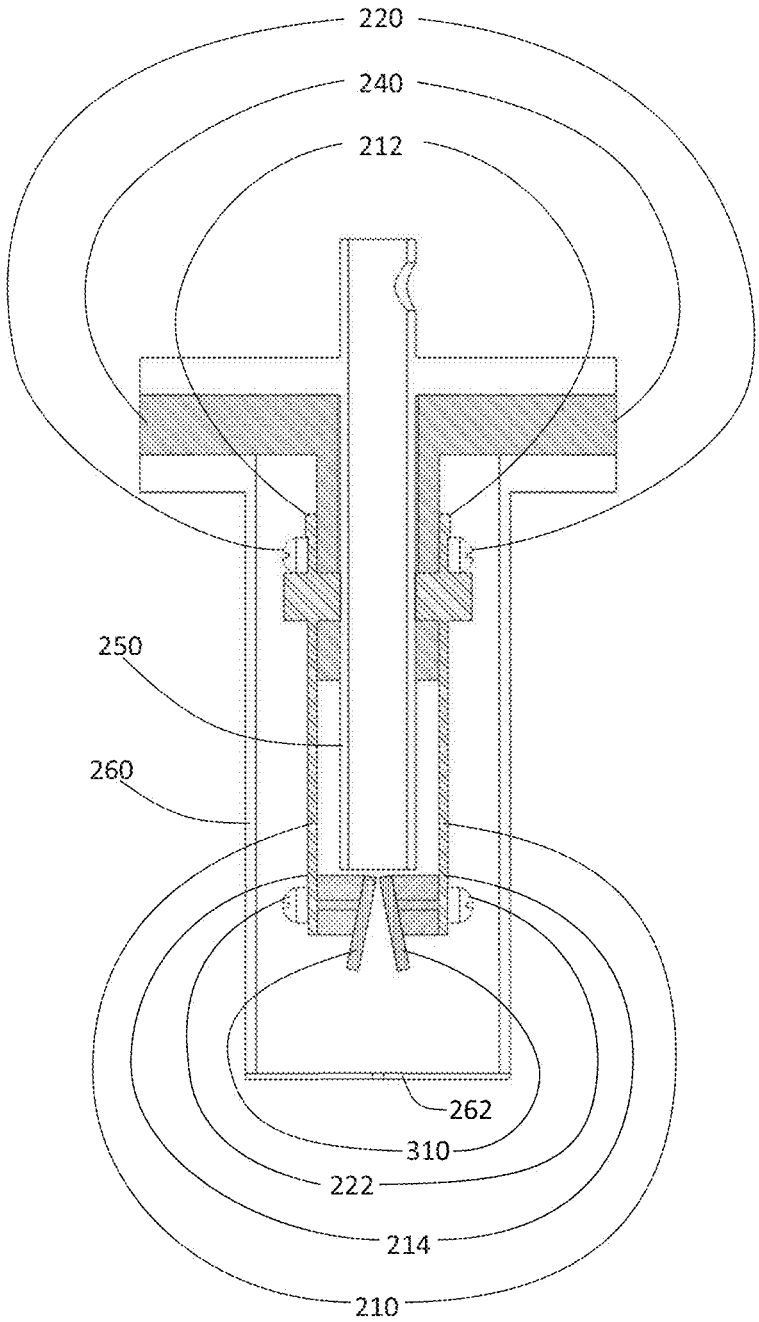
FIG. 3A is a schematic of illustration of an exemplary embodiment of the invention including a single crystal material blade.

In an exemplary embodiment, blade 230 includes a single crystal of material blade 310, as shown in FIG. 3A. In an exemplary embodiment, single crystal of material blade 310 is tungsten.

Inner Lining Tube

Referring to FIG. 2A and FIG. 2B, in a further embodiment, the present invention further includes an inner lining tube 250 that is configured to protect bender 210 from impinging radiation from beam 140. In an exemplary embodiment, inner lining tube 250 is sealed at both ends of inner lining tube 250.

Outer Lining Tube

Referring to FIG. 2A and FIG. 2B, in a further embodiment, the present invention further includes an outer lining tube 260 that surrounds inner lining tube 250. In an exemplary embodiment, the present invention further includes a cap 262 that is attached to outer lining tube 260.

General

In an exemplary embodiment, the present invention provides four piezoelectric bender arms 210 arranged in two perpendicular pairs parallel to incoming beam 140. Beam defining slit blades 230 are mounted at the tips 214 of bender arms 210. As a voltage is applied to a particular piezo bender arm 210, the bender arm 210 bends either towards, or away from, beam 140 to the extent that the gap between the tip blades 230 may be closed up completely (shutting off beam 140 entirely) or opened sufficiently to let the full un-apertured beam 140 pass through. In an exemplary embodiment, strain gauges mounted on piezo bender arm 210 measure and control the deflection of piezo bender arm 210 via feedback, allowing the gap between blades 230 to be set rapidly and. with very high precision. Thus, by varying the applied voltage, in an exemplary embodiment, the present invention could form an aperture of a desired size between the two extremes. In an exemplary embodiment, an inner liner tube 250 of a dense material lies between the path of beam 140 and the piezo bender arms 210 to prevent rays of beam 140 (e.g., X-rays) that might be scattered out of the very intense beam 140 from hitting piezo bender arms 210 and potentially damaging them. In an exemplary embodiment, a concentric outer ling tube 260 and an end-cap 262 with a small exit hole (also both made from a dense material) prevents any rays from beam 140 (e.g., X-rays) that might be scattered from the slit blades 230 or other sources within the system from exiting the present invention where such rays might potentially interfere with an experiment involving beam 140 and the present invention. In an exemplary embodiment, outer lining tube/cylinder 260 allows the present invention to be mounted securely and reproducibly within a locating V-block.

In an exemplary embodiment, the present invention uses piezo benders 210 instead of pushers. The motion of piezo bender 210 is still somewhat small compared to the length of piezo bender 210 but the motion is now perpendicular to the length of piezo bender 210 instead of along it. This means that the tong piezo benders 210 can be arranged to form a compact space-saving cylinder that tightly encases the beam 140. Also, since piezo bender 210 serves as its own lever arm by bending all along its length, the ultimate motion of slit blade 230 at tip 214 is amplified, meaning that the present invention could be capable of significantly greater motion than a conventional piezo stack actuator driven system of a similar size.

In an exemplary embodiment, the present invention provides for a solid-state aperture that contains no mechanical moving parts. In an exemplary embodiment, the present invention contains fewer than a dozen unique parts. In an exemplary embodiment, piezo bender arms 210 are standard industrial components which are available in a range of different sizes and specifications to meet different requirements.

In an exemplary embodiment, the present invention could allow for tightly coordinated motions of multiple bender arms 210, As a result, the present invention could allow for complex synchronized motions of bender arms 210, such as (i) scanning an aperture with a gap of a precisely fixed width rapidly through beam 140 or (ii) opening or closing the aperture at a precisely controlled position or time intervals in a "strobe-like" manner. The present invention also could allow for determining the size and/or position abeam 140 by scanning slit blades 230 rapidly through beam 140 white measuring the intensity of the transmitted beam.

Figure 3B:
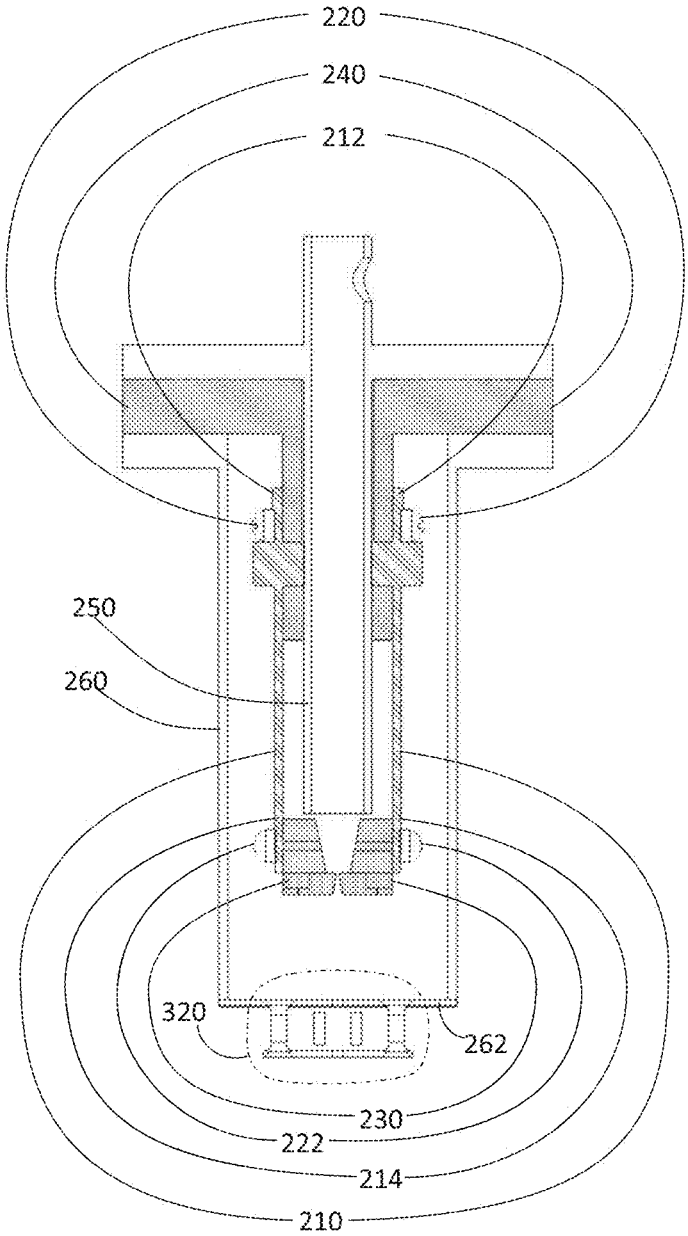
FIG. 3B is a schematic illustration of an exemplary embodiment of the device of FIG. 3A further including an ion chamber.

In an exemplary embodiment, the present invention could allow for incorporating additional capabilities and diagnostics within the present invention without impacting the core functionality of the present invention. For example, as shown in FIG. 3B, the present invention further includes an ion chamber 320 attached to cap 262. In an exemplary embodiment, ion chamber 320 is configured to measure the flux of beam 140. In an exemplary embodiment, ion chamber 320 includes electrodes.

In an exemplary embodiment, the present invention is designed to "fail-safe" such that if the power to the present invention fails, bender arms 210 could be configured to return to their rest position, which can be either the fully open or fully closed position as required, depending upon an initial configuration of the present invention.

In an exemplary embodiment, the present invention is compatible with vacuum or other harsh environments with little modification.

Additional Embodiments

Figure 4:
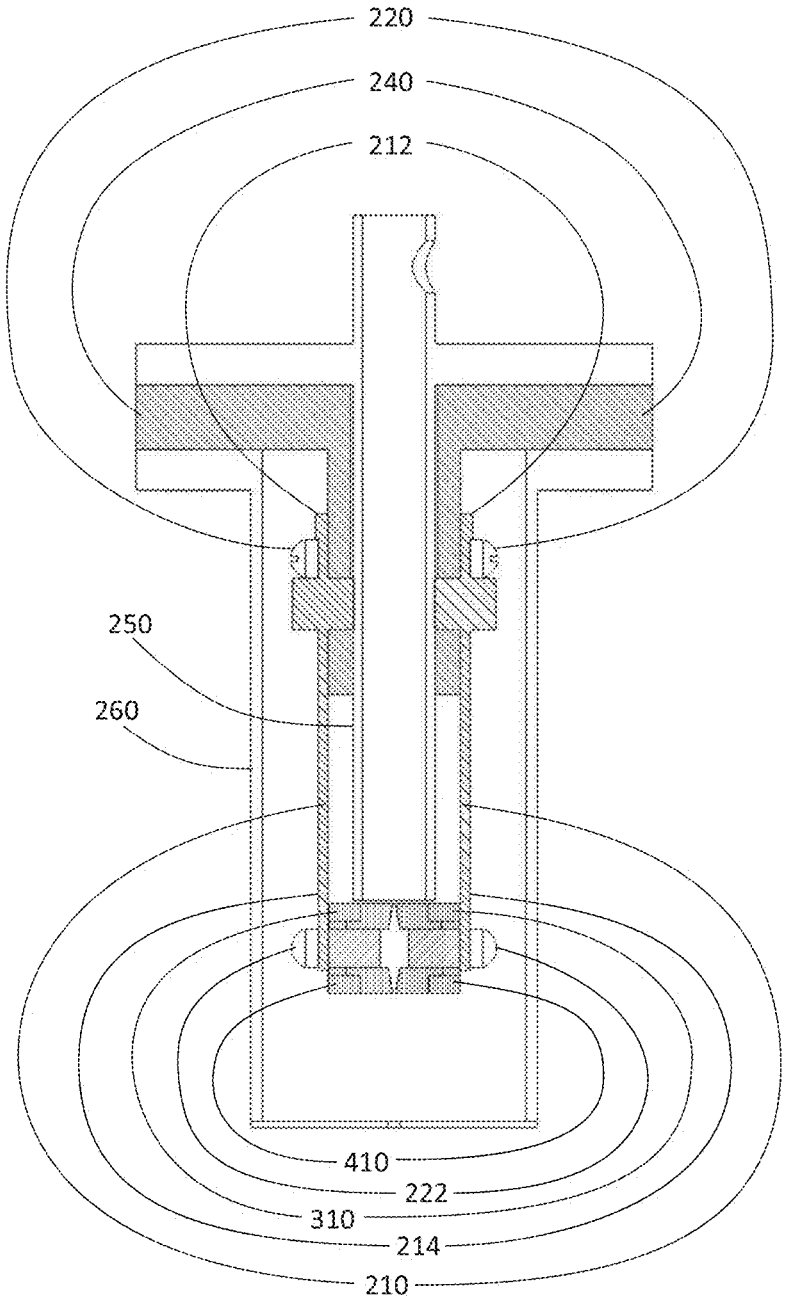
FIG. 4 is a schematic illustration of a device according to an exemplary embodiment of the invention including two jaw blades mounted on each of the bender arms.

Referring to FIG. 4, in an additional embodiment, the present invention includes two jaw blades 410 mounted on each bender arm 210. In an exemplary embodiment, the upstream pair of jaw blades 410 is used to control the size of the beam and the downstream pair of jaw blades 420 is used to eliminate any rays of the beam (e.g., X-rays) scattered off the first pair of slit blades 410.

Figure 5:
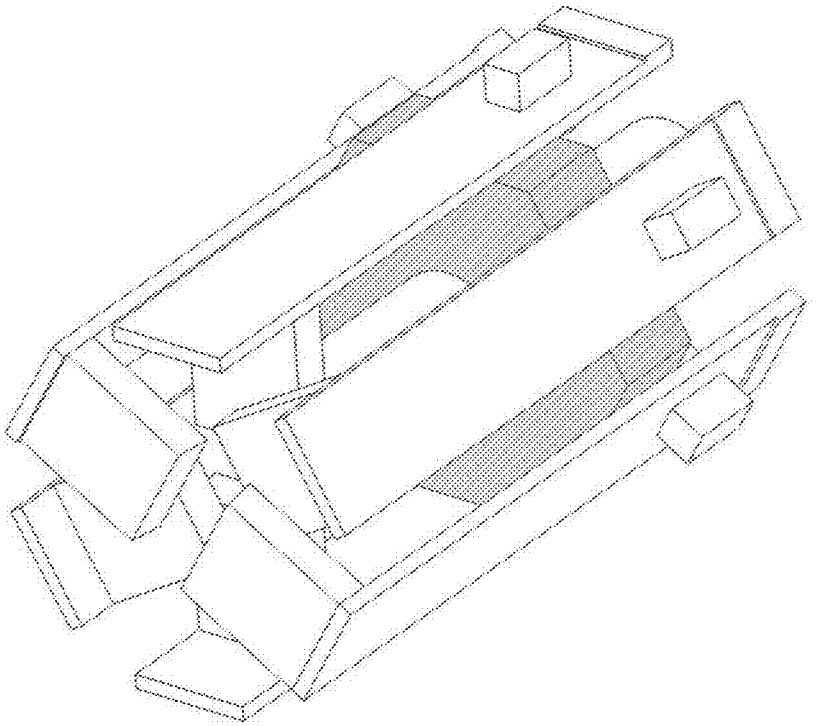
FIG. 5 is a schematic three dimension illustration of a device according to an exemplary embodiment of the invention including three pair of bender arms.

Referring to FIG. 5, in an additional embodiment, the present invention includes three pairs of bender arms.

Figure 6:
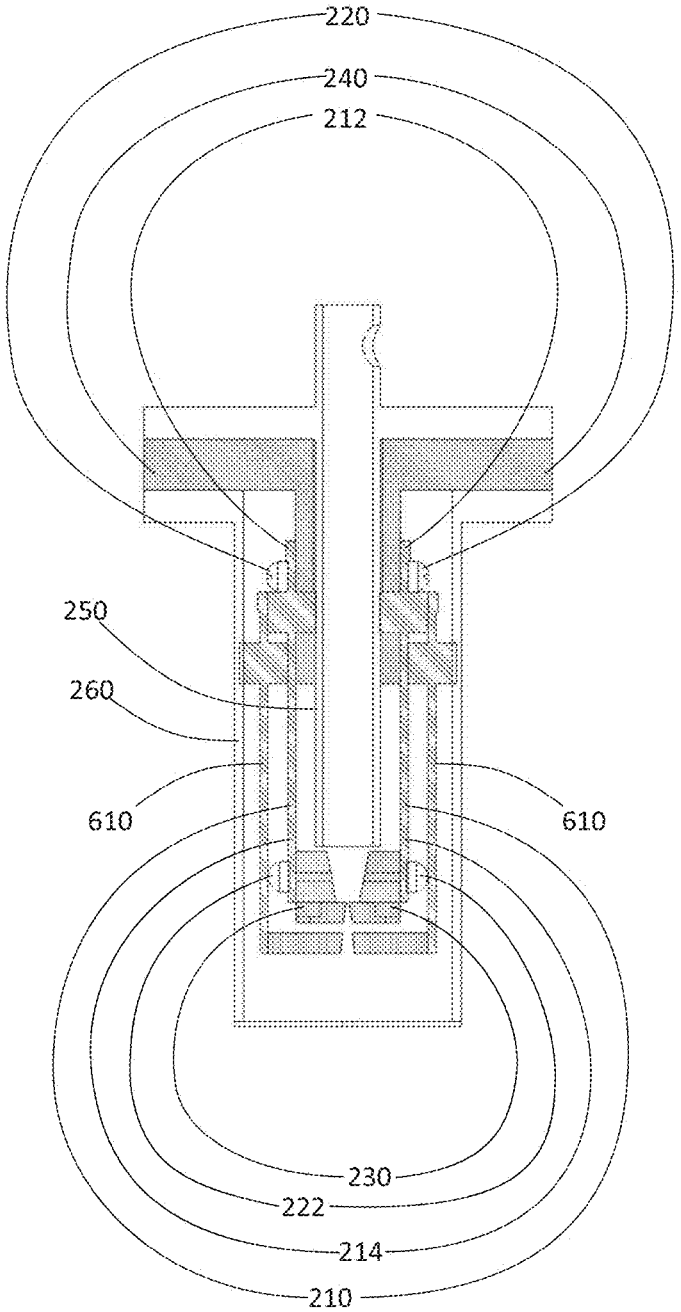
FIG. 6 is a schematic illustration of a device according to yet another exemplary embodiment of the invention.

Referring to FIG. 6, in an additional embodiment, the present invention includes an additional pair of independent piezoelectric bender arms 610 with additional blades 620 attached to additional bender arms 610. In an exemplary embodiment, additional blades 620 may be used to eliminate any potential scatter caused by blades 230. In an alternative embodiment, blades 230 or additional blades 620 may perform an alternative role such as functioning as a shutter. In a further embodiment, additional bender arms may be added upstream or downstream.

Conclusion

It is to be understood that the above description and examples are intended to be illustrative and not restrictive, Many embodiments will be apparent to those of skill in the art upon reading the above description and examples. The scope of the invention should, therefore, be determined not with reference to the above description and examples, but should instead be determined with reference to the appended claims, along with the full scope of equivalents to which such claims are entitled, The disclosures of all articles and references, including patent applications and publications, are incorporated herein by reference for all purposes.

What is claimed is:

1. An adjustable aperture for controlling the dimensions of a beam of energy comprising:

at least one piezoelectric bender, wherein a fixed end of the bender is attached to a common support structure via a first attachment and wherein a movable end of the bender is movable in response to an actuating voltage applied to the bender; and at least one blade attached to the movable end of the bender via a second attachment such that the blade is capable of impinging upon the beam.

2. The aperture of claim 1 wherein the first attachment comprises plastic.

3. The aperture of claim 1 wherein the bender is positioned approximately parallel to the beam.

4. The aperture of claim 1 wherein the support structure comprises holes through which the bender can pass.

5. The aperture of claim 1 wherein the bender comprises at least one strain gauge.

6. The aperture of claim 5 wherein the gauge is configured to measure dimensional changes of the bender.

7. The aperture of claim 6 wherein the gauge is configured to provide data about the position of the blade.

8. The aperture of claim 1 wherein the blade is approximately perpendicular to the beam.

9. The aperture of claim 1 wherein the bender comprises:

at least one actuator conductor;

at least one signal conductor; and at least one reference conductor.

10. The aperture of claim 9 wherein the actuator conductor and the reference conductor are configured to carry the actuating voltage.

11. The aperture of claim 9 wherein the signal conductor and the reference conductor are configured to carry a signal from at least one strain gauge attached to the bender.

12. The aperture of claim 9 wherein at least one of the conductors is attached to the support structure via a third attachment.

13. The aperture of claim 1 wherein the bender comprises a non-conducting material.

14. The aperture of claim 13 wherein the material can be electrically isolated.

15. The aperture of claim 1 wherein the blade is configured as an electrical conductor.

16. The aperture of claim 1 wherein the blade is configured as an electrical emitter.

17. The aperture of claim 1 further comprising an inner lining tube that is configured to protect the bender from impinging radiation from the beam.

18. The aperture of claim 17 wherein the tube is seated at both ends of the tube.

19. The aperture of claim 17 further comprising an outer lining tube that surrounds the inner lining tube.

20. The aperture of claim 19 further comprising a cap that is attached to the outer lining tube.

21. The aperture of claim 1 wherein the blade comprises a single crystal of material.

22. An adjustable aperture for limiting the dimension of a beam of energy comprising at least one piezoelectric bender, wherein a fixed end of the bender is attached to a common support structure via a first attachment and wherein a movable end of the bender is movable in response to an actuating voltage applied to the bender, thereby being able to impinge upon the beam.

23. An adjustable aperture for limiting the dimension of a beam of particles comprising:

at least one piezoelectric bender, wherein a fixed end of the bender is attached to a common support structure via a first attachment and wherein a movable end of the bender is movable in response to an actuating voltage applied to the bender; and at least one blade attached to the movable end of the bender via a second attachment such that the blade is capable of impinging upon the beam.

24. An adjustable aperture for reducing the dimension of a beam of particles comprising at least one piezoelectric bender, wherein a fixed end of the bender is attached to a common support structure via a first attachment and wherein a movable end of the bender is movable in response to an actuating voltage applied to the bender, thereby being able to impinge upon the beam.

* * * * *